United States Patent [19]

Hamilton

[11] 4,018,208

[45] Apr. 19, 1977

[54] HOT AIR ANDIRON

[75] Inventor: David Hamilton, Lee County, Miss.

[73] Assignee: Tom Lauderdale Machine Shop, Inc., Shannon, Miss. ; a part interest

[22] Filed: June 9, 1975

[21] Appl. No.: 585,328

[52] U.S. Cl. ..... 126/121; 237/51

[51] Int. Cl.[2] ..... F24B 7/00

[58] Field of Search ..... 126/164, 165, 121, 298; 237/51; 248/122, 289

[56] References Cited

UNITED STATES PATENTS

| | | | |
|---|---|---|---|
| 1,030,002 | 6/1912 | Livingston | 126/164 |
| 1,537,736 | 5/1925 | Bennett | 126/121 |
| 2,828,078 | 3/1958 | Snodgrass | 126/121 |
| 3,001,521 | 9/1961 | Reilly | 237/51 |
| 3,880,141 | 4/1975 | Abshear | 126/121 |
| 3,911,894 | 10/1975 | Richard, Jr. et al. | 126/121 |

FOREIGN PATENTS OR APPLICATIONS

| | | | |
|---|---|---|---|
| 179,812 | 5/1922 | United Kingdom | 237/51 |

*Primary Examiner*—John J. Camby
*Assistant Examiner*—Larry I. Schwartz
*Attorney, Agent, or Firm*—Woodhams, Blanchard and Flynn

[57] ABSTRACT

A hot air andiron for use in a fireplace instead of a regular andiron or grate. The hot air andiron comprises a C-shaped section fabricated from a pipe of substantial diameter. The C-shaped section has substantially parallel leg portions, and an inlet header is connected to one leg portion adjacent the free end thereof for supplying air into and through the C-shaped section. The header has a fan associated with the inlet end thereof, and the other leg portion of the C-shaped section has a discharge opening at the free end thereof for discharge of heated air. The C-shaped section is supported on legs which space it several inches above the floor. The parallel leg portions are positioned to permit logs to be supported directly thereon and extend transversely therebetween, and log holding elements are fixed to the leg portions and project upwardly therefrom for assisting in holding the logs on the leg portions.

9 Claims, 6 Drawing Figures

HOT AIR ANDIRON

FIELD OF THE INVENTION

This invention relates to an improved fireplace heater which is designed as an andiron for supporting the logs.

BACKGROUND OF THE INVENTION

Numerous fireplace heaters have been devised in an attempt to more efficiently utilize the energy generated by a fire within a fireplace. However, in these known devices, the maximum extraction of heat energy from the fire for use in heating the adjacent room is not possible.

In some of these known fireplace heaters, the heater is formed as a log-supporting grate and includes a plurality of central support members for supporting the logs, which support members are in turn connected to a main heating tube which surrounds the logs and likewise surrounds the fire which is created by the logs. This type of hot air grate does not, however, permit a maximum heating of the room since the fire is normally concentrated in the grate, so that the hot air tube or pipe surrounds the fire and accordingly is not heated to the maximum extent. Further, the grate normally consists of solid bars or the like which are directly in the fire, and inasmuch as they do not have any cool air flowing therethrough, these bars become damaged by the fire and this greatly shortens the useful life of the grate. This type of grate also requires a larger number of elements, and accordingly the grate is of substantially greater weight and cost.

Some of the known fireplace heaters have also functioned as grates which are positioned directly on the floor of the fireplace and have the fire built directly thereover. Fireplace heaters of this type have also proven undesirable since this structure prevents the air from flowing into the fireplace from beneath the fire, and thus severely restricts the proper burning of the logs. Further, when the hot air pipe rests on the floor of the fireplace and has the fire built directly thereover, there is a tendency for the hot air pipe to extract the heat from the fire too rapidly, so that it is difficult to keep the logs burning.

Accordingly, it is an object of the present invention to provide an improved fireplace heater which overcomes the abovementioned disadvantages. In particular, it is an object of the present invention to provide an improved fireplace heater which functions as an andiron, rather than as a grate as in the known heaters.

A further object of the present invention is to provide a fireplace heater, as aforesaid, which is formed as an andiron and has a C-shaped section fabricated of pipe of substantial diameter, which pipe defines an air flow passage therethrough for discharging heated air from one end of the C-shaped section.

Still a further object of the invention is to provide a fireplace heater, as aforesaid, wherein a header connects to the other end of the C-shaped section and is supplied with air by a fan so that a forced flow of air through the C-shaped section occurs, with the heated air being forceably discharged from the C-shaped section into the adjacent room.

Another object of the present invention is to provide an improved fireplace heater, as aforesaid, wherein the C-shaped section has substantially parallel legs which function as an andiron and permit the logs to be supported thereon, which logs extend across the opening defined between the legs for permitting the maintaining of a hot bed of coals in the middle of the C-shaped section.

Still another object of the present invention is to provide an improved fireplace heater, as aforesaid, which functions as an andiron for supporting the logs during burning, which permits the maximum extraction of heat from the fire for supply to the adjacent room without imparing the ability of the fire to keep itself burning, which supports the logs spaced from the floor of the fireplace to permit the proper supply of air to the fire and to permit proper burning of the logs.

A further object of the present invention is to provide a fireplace heater, as aforesaid, which can be efficiently and economically manufactured, which can be conveniently handled and shipped in a disassembled condition, which can be easily assembled by relatively unskilled persons directly at the location of use, and which is interchangeable so as to permit the fan to be disposed on either side of the fireplace opening.

Other objects and purposes of the present invention will be apparent to persons familiar with structures of this type upon reading the following specification and inspecting the accompanying drawings.

SUMMARY OF THE INVENTION

The objects and purposes of the present invention, including those set forth above, have been met by providing a fireplace heater which includes a C-shaped section fabricated from pipe and positioned within the fireplace so that the legs of the C-shaped section project outwardly. The C-shaped section is supported on legs which space it several inches above the floor. A header is connected to the free end of one leg, which header has a motor-driven fan associated therewith so that fresh air is drawn into the header and forced through the C-shaped section. A discharge opening is formed in the free end of the other leg for permitting discharge of heated air after having passed through the C-shaped section. A plurality of log holding elements are fixed to the legs and project upwardly therefrom for permitting a plurality of logs to be supported directly on and extend transversely between the legs. When the logs burn, the heat of conduction from the fire is transmitted directly to the pipe for heating the air flowing therethrough. The burning fire creates a bed of coals within the opening between the legs, which bed of coal, by both conduction and radiation, assists in heating the pipe. Since the C-shaped section opens outwardly of the fireplace, the maximum radiation of heat energy from the fire also occurs outwardly from the fireplace.

DETAILED DESCRIPTION

Figure 1:
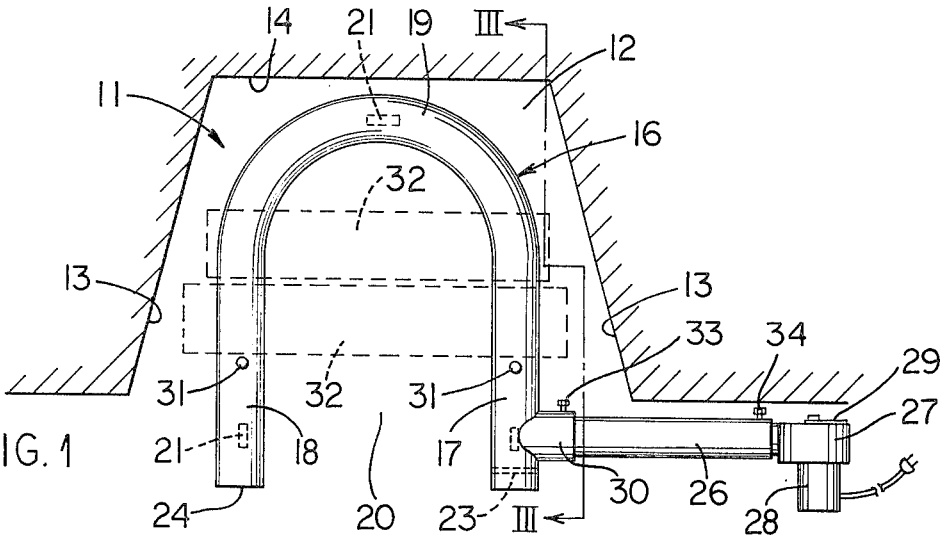
FIG. 1 is a top view of a hot air andiron according to the invention.
Figure 2:
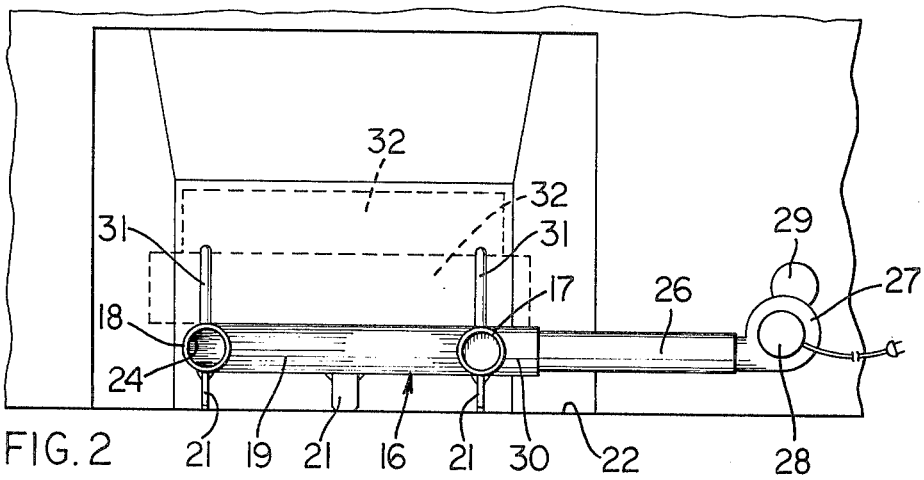
FIG. 2 is a front view of the structure appearing in FIG. 1.
Figure 3:
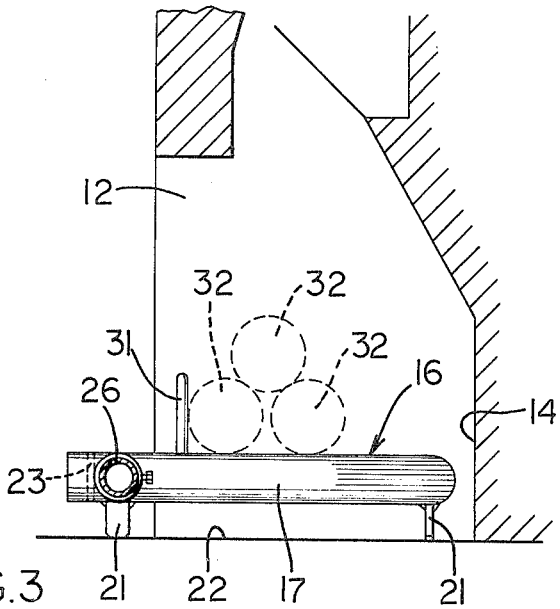
FIG. 3 is a side view taken substantially along the line III—III in FIG. 1.

Referring to the FIGS. 1–3, there is illustrated a fireplace heater 11 according to one embodiment of the present invention, which heater 11 functions as a hot air andiron in that it both supports the logs and permits the forced discharge of heated air into the adjacent room.

The andiron 11 is illustrated as being positioned in a conventional fireplace opening 12, which is defined by opposed sidewalls 13 and a back wall 14. The andiron 11 includes a C-shaped section 16 which defines substantially parallel legs 17 and 18 interconnected by a curved center portion 19. The C-shaped section 16 is preferably fabricated from steel pipe, such as conventional black pipe, which pipe is preferably of substantial diameter, such as in the range of 2 ½ to 3 ½ inches. The legs 17 and 18 define therebetween a region or space 20 which is totally open and which is completely free of any other structure associated with the heater.

The front end of the leg 17 is closed in any desired manner, but in the illustrated embodiment the front end of leg 17 is closed by a plug 23 which is fixed to the leg as by being press-fit and/or welded thereto. The plug 23 is preferably spaced slightly inwardly from the free end of the leg so as to not detract from the appearance of the andiron. The other leg 18 has the free end open so as to define an outlet opening 24 for the discharge of the heated air.

The C-shaped section 16 is provided with a plurality of legs 21 fixedly secured thereto, which legs 21 engage the floor 22 and maintain the C-section 16 spaced upwardly a selected distance above the floor. The legs 21, in this embodiment, are fabricated from steel plate and are welded to the bottom side of the C-section 16, preferably maintaining the C-section about 2 to 3 inches above the floor to permit the proper supply of cool air to the fire, and to also permit the proper supply of cool air into the fire below the stream of hot air which is discharged from the opening 24.

The cool air is supplied to the andiron by a header 26. The header 26 comprises a pipe, preferably of steel, and same has one end thereof connected to the discharge end of a conventional centrifical fan 27 driven by an electric motor 28. The fan 27 has an inlet opening (not shown) associated with the rearward side thereof, whereby cool air can be withdrawn from the room into the fan and supplied to the header 26. The flow of room air into the fan 27 can be regulated by a valve 29, which valve comprises a plate which can be swingably moved so as to partially or totally uncover the inlet opening to the fan.

The other end of the header pipe 26 extends into a pipe section 30 which is secured, as by welding, to the leg 17 adjacent the free end thereof. The pipe section 30 communicates with the leg 17 at a location spaced inwardly from the plug 23. The end of the header 26 is preferably slidably received within the pipe section 30 and fixedly connected thereto by a set screw or bolt 33, thereby permitting the header 26 to be disconnected from the C-section 16 to facilitate the shipping and handling of the andiron. The other end of the header 26 is also preferably slidably connected to the outlet pipe of the fan 27, being fixed thereto by a bolt or set screw 34.

Andiron 11 is also preferably provided with a plurality of log holding or engaging elements 31 projecting upwardly therefrom, which elements in the illustrated embodiment comprise vertically extending pinlike members which project upwardly from the legs 17 and 18 adjacent the forward ends thereof. The holding elements 31 assist in holding a plurality of logs 32 in position on the andiron, and particularly function to prevent the logs from rolling forwardly out of the fireplace. The elements 31 may be welded to the legs 17 and 18 or, if desired, they can be removably mounted on the andiron, as by having the ends of the elements 31 received within suitable sockets secured to the andiron.

While not illustrated in FIGS. 1–3, one or more additional log holding members 31 can be provided adjacent the rear of the andiron for preventing the logs from falling rearwardly against the back wall of the fireplace. For example, a further log holding element 31 could be secured to and project upwardly from the center of the curved portion 19 if desired.

In a desirable embodiment of the invention, the C-section 16 is preferably constructed from steel pipe having an outer diameter of approximately 3 inches. The transverse spacing between the center lines of the legs 17 and 18 is preferably in the range of 16 to 20 inches, whereupon conventional logs 32 which are normally approximately 24 inches in length can then be positioned to rest directly on and extend transversely between the legs 17 and 18 as illustrated by dotted lines in FIGS. 1–3. The overall depth of the andiron, that is the dimension from the free ends of the legs to the rearward edge of the center section 19, is normally in the range of 25 to 30 inches so that the andiron will readily fit conventional fireplace openings. The legs 21 are preferably in the range of 2to 3 inches high so as to provide for optimum spacing of the andiron above the floor of the fireplace. The length of the header 26 can be suitably varied, such as from approximately 8 inches to approximately 20 inches depending upon the width of the fireplace.

OPERATION

A plurality of logs 32 are positioned on the andiron 11 so that the logs are supported on and extend transversely between the legs 17 and 18. The logs are disposed just rearwardly of the holding elements 31, which elements prevent the logs from falling forwardly out of the fireplace. Since the legs 21 maintain the C-section 16 spaced upwardly from the floor 22 of the fireplace, and inasmuch as the logs 32 are themselves supported on the upper surface of the C-section 16, the logs are thus spaced a substantial distance above the floor 22 as illustrated in FIG. 3, whereby proper draft and circulation of air within the fireplace can be achieved so as to result in optimum burning of the logs.

When the logs have been positioned, they can be ignited in a conventional manner, as by building a small fire under the logs utilizing kindling, newspapers or the like. Since the logs 32 are spaced upwardly a substantial distance from the floor 32, the building of a starting fire under the logs is greatly facilitated.

After starting fire has had an opportunity to cause burning of the logs 32, and after the logs 32 themselves are burning properly, the motor 28 is then energized so as to drive the fan 27. The inlet baffle 29 is manually adjusted so as to give the desired air flow through the andiron. The cool air is pulled from the room by the fan and blown through the header 26 into the C-section 16, whereupon the air flows through the C-section 16 and is discharged from the opening 24. In the andiron of the present invention, the air as discharged from the opening 24 emerges at a temperature of 350° to 400° F with a medium size fire.

Since the burning logs 32 are supported directly on the legs 17 and 18 of the andiron, the heat of the fire results in maximum heating of the C-section 16, which heat by conduction is transmitted to the air flowing through the C-section. The burning logs also result in the collection of hot coals in the space 20 within the C-section 16, which hot coals are located directly under the logs and greatly assist in keeping the logs burning. Since the space 20 opens outwardly into the room, and since the fire is located on top of the andiron and within the open space 20, the andiron 11 permits the maximum use of radiant heat from the fireplace while not visually obstructing the fire. Since the burning logs are supported on the andiron, which andiron extracts the heat directly from the fire, the fire thus burns at a cooler temperature so that the logs burn over a longer period of time. The andiron thus results in the usage of less wood, while at the same time results in greater transference of fireplace heat into the adjacent room.

The andiron as described above is also desirable since, inasmuch as the space 20 is completely open, and since the C-section 16 is spaced upwardly a substantial distance above the floor, the cleaning of the fireplace and the removal of ashes is greatly simplified.

While the invention as illustrated and described discloses the use of a curved center section 19, nevertheless it will be appreciated that the C-section 16 could utilize a straight center section 19 for joining the legs 17 and 18. Further, the legs 17 and 18 could extend at a small angle with respect to one another if desired.

MODIFICATION

Figure 4:
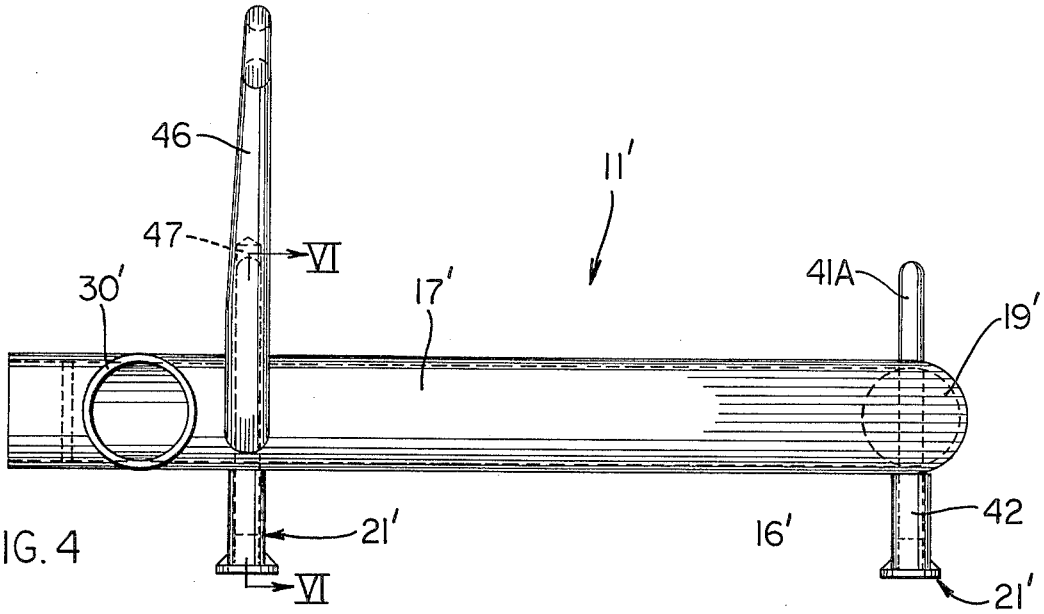
FIG. 4 is a side view similar to FIG. 3 and illustrating a modified andiron according to the invention.
Figure 5:
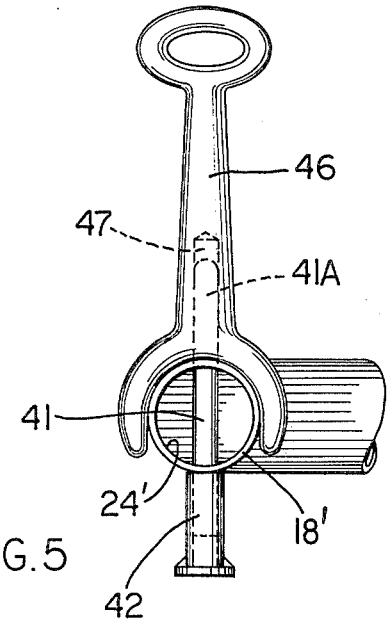
FIG. 5 is a fragmentary front view of the structure appearing in FIG. 4.
Figure 6:
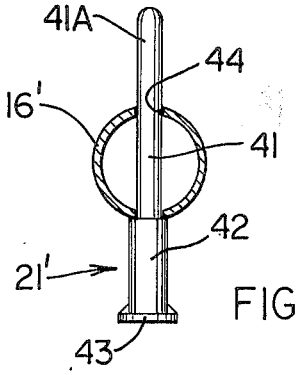
FIG. 6 is a sectional view taken along the line VI—VI in FIG. 4, the decorative dog iron being eliminated for clarity of illustration.

FIGS. 4–6 illustrate a modified andiron which is similar to the andiron of FIGS. 1–3 so that corresponding parts have been identified by the same reference numerals but with a prime (′) added thereto.

The andiron 11′ again includes a C-shaped pipe section 16′ having an opening 24′ formed in the front end of the one leg 18′, and having a pipe section 30′ connected to the front end of the other leg 17′, which pipe section 30′ is adapted for connection to a header in the manner illustrated in FIGS. 1–3.

The C-shaped pipe section 16′ is supported on three legs 21′, one being disposed adjacent the free end of each leg section 17′ and 18′, and the other being disposed adjacent the center of the curved portion 19′. In this embodiment, each leg 21′ comprises an elongated steel rod 41 which has the lower end thereof fixedly secured to, as by being press-fitted into, a pipe element 42. A washer 43 is secured to the lower end of the pipe element 42, as by being welded thereto, so as to form a foot. The rod 41 extends through a hole 44 which is drilled through the pipe section 16′ so that the upper portion 41A of the rod 41 projects upwardly a substantial distance above the C-section 16′. The projecting upper end portions 41A of the rods 41 will function as the log holding elements 31 illustrated in FIGS. 1–3. The rods 41 are of a diameter substantially equal to but slightly smaller than the openings 44 so that the rods 41 can be freely pressed through the openings 44, while at the same time the rods will substantially close off the openings 44 when the andiron is assembled. When assembled in this manner, the C-shaped pipe section 16′ is supported on the upper ends of the pipe elements 42 so as to be spaced a preselected distance above the floor.

In this illustrated embodiment, each of the legs 21′ has a rod portion 41A projecting upwardly above the C-section 16′ so that a log engaging element is thus disposed adjacent the forward end of each leg portion 17′ and 18′, and in addition, a log holding portion 41A also projects upwardly from the curved section 19′.

Use of the legs 21′ is highly desirable since the C-section 16′ and the legs 21′ can be shipped in a disassembled condition and then readily assembled at the location of use. Further, the legs 21′ can be readily slidably inserted through the openings 44 from either side of the C-section 16′. In this manner, the C-section 16′ can be selectively reversed so that the pipe section 30′ and the appropriate air supply header can thus be disposed on either the right or left side of the fireplace.

As a further alternative, FIGS. 4 and 5 illustrate the use of removable decorative dog irons 46 which can be slidably positioned over the frontmost log holding members 41A. The decorative dog iron 46 comprises an elongated member which has an opening 47 formed therein so as to snugly but slidably accommodate the log holding portion 41A. The dog iron 46 may have any desired decorative shape and, in the illustated embodiment, has a loop formation at the upper end thereof and a curved arcuate configuration at the lower end thereof which partially surrounds the individual leg portions 17′ and 18′. In addition to performing a decorative function, the dog irons 46 also function as log holding stops so as to permit a substantial quantity of logs to be supported on the andiron without falling forwardly out of the fireplace. Since these dog irons can be readily removed from the andiron by lifting them off the rods 41A, they do not interfere with the stacking or loading of logs into the fireplace.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A combined heater-andiron for a fireplace, comprising:

andiron means for supporting thereon logs which are to be burned, said andiron means consisting of a C-shaped member formed from a hollow pipe and including a pair of hollow pipelike leg portions disposed in substantially parallel relationship and interconnected by a pipelike center portion, the space within said C-shaped member being completely open;

leg means attached to said andiron means and projecting downwardly therefrom for supporting said andiron means in a substantially horizontal plane spaced upwardly above a supporting floor, said leg means including a plurality of leg elements attached to said C-shaped member and projecting downwardly therefrom, said leg elements being disposed directly under the pipelike portions forming the C-shaped member;

one of said pipelike leg portions having a discharge opening formed in the free end thereof for permitting a substantially horizontally directed stream of heated air to be discharged from said C-shaped member, the other pipelike leg portion being closed in the vicinity of the free end thereof;

said discharge opening as formed in the free end of said one pipelike leg portion comprising the sole discharge opening for the discharge of heated air, and the free end of said other pipelike leg portion having plug means associated therewith for closing same, said plug means being spaced inwardly from the free end of said other leg portion so as to give the free end of said other leg portion the appearance of an open pipe;

an air supply pipe connected to said other pipelike leg portion at a location spaced inwardly from said plug means for supplying cool air into the interior of said C-shaped member, said air supply pipe having one end thereof connected to said other pipelike leg portion at a location spaced inwardly from the closed free end thereof, said air supply pipe being disposed within substantially the same plane as said C-shaped member and extending outwardly therefrom in substantially transverse relationship to said other pipelike leg portion;

means associated with the other end of said air supply pipe for supplying cool air through said air supply pipe into said C-shaped member; and an elongated log holding element associated with each of said pipelike leg portions and projecting upwardly therefrom for engaging the logs which are supported on said C-shaped element and for preventing the logs from rolling out of the fireplace, the elongated log holding elements being located on the pipelike leg portions in the vicinity of but spaced inwardly from the free ends thereof.

2. A combined heater-andiron for a fireplace, comprising: andiron means for supporting thereon logs which are to be burned, said andiron means consisting of a C-shaped member formed from a hollow pipe and including a pair of hollow pipelike leg portions disposed in substantially parallel relationship and interconnected by a pipelike center portion, the space within said C-shaped member being completely open;

leg means attached to said andiron means and projecting downwardly therefrom for supporting said andiron means in a substantially horizontal plane spaced upwardly above a supporting floor, said leg means including a plurality of leg elements attached to said C-shaped member and projecting downwardly therefrom, said leg elements being disposed directly under the pipelike portions forming the C-shaped member;

one of said pipelike leg portions having a discharge opening formed in the free end thereof for permitting a substantially horizontally directed stream of heated air to be discharged from said C-shaped member, the other pipelike leg portion being closed in the vicinity of the free end thereof;

an air supply pipe connected to said other pipelike leg portion for supplying cool air into the interior of said C-shaped member, said air supply pipe having one end thereof connected to said other pipelike leg portion at a location spaced inwardly from the closed free end thereof, said air supply pipe being disposed within substantially the same plane as said C-shaped member and extending outwardly therefrom in substantially transverse relationship to said other pipelike leg portion;

means associated with the other end of said air supply pipe for supplying cool air through said air supply pipe into said C-shaped member;

an elongated log holding element associated with each of said pipelike leg portions and projecting upwardly therefrom for engaging the logs which are supported on said C-shaped element and for preventing the logs from rolling out of the fireplace, the elongated log holding elements being located on the pipelike leg portions in the vicinity of but spaced inwardly from the free ends thereof;

said plurality of leg elements being separate from said C-shaped member and removably connected thereto, and said log holding elements as associated with said pipelike leg portions being fixed to and comprising a portion of said leg members.

3. A combined heater-andiron for a fireplace, comprising:

andiron means for supporting thereon logs which are to be burned, said andiron means consisting of a C-shaped member formed from a hollow pipe and including a pair of hollow pipelike leg portions disposed in substantially parallel relationship and interconnected by a pipelike center portion, the space within said C-shaped member being completely open;

leg means attached to said andiron means and projecting downwardly therefrom for supporting said andiron means in a substantially horizontal plane spaced upwardly above a supporting floor, said leg means including a plurality of leg elements attached to said C-shaped member and projecting downwardly therefrom, said leg elements being disposed directly under the pipelike portions forming the C-shaped member;

one of said leg members being associated with each of said pipelike leg portions adjacent the free end thereof, each of said latter-mentioned leg members having an upper part which projects upwardly above the respective pipelike leg portion;

one of said pipelike leg portions having a discharge opening formed in the free end thereof for permitting a subsantially horizontally directed stream of heated air to be discharged from said C-shaped member, the other pipelike leg portion being closed in the vicinity of the free end thereof;

an air supply pipe connected to said other pipelike leg portion for supplying cool air into the interior of said C-shaped member, said air supply pipe having one end thereof connected to said other pipelike leg portion at a location spaced inwardly from the closed free end thereof, said air supply pipe being disposed within substantially the same plane as said C-shaped member and extending outwardly therefrom in substantially transverse relationship to said other pipelike leg portion;

means associated with the other end of said air supply pipe for supplying cool air through said air supply pipe into said C-shaped member; p1 en elongated log holding element associated with each of said pipelike leg portions and projecting upwardly therefrom for engaging the logs which are supported on said C-shaped element and for preventing the logs from rolling out of the fireplace, the elongated log holding elements being located on the pipelike leg portions in the vicinity of but spaced inwardly from the free ends thereof; and said log holding element comprising a vertically elongated decorative dog iron slidably positioned over the upper part of said leg portion and projecting upwardly therefrom, said dog irons being removable by slidably lifting same upwardly away from said C-shaped member.

4. A combined heater-andiron for a fireplace, comprising :

andiron means for supporting thereon logs which are to be burned, said andiron means consisting of a C-shaped member formed from a hollow pipe and including a pair of hollow pipelike leg portions disposed in substantially parallel relationship and interconnected by a pipelike center portion which is adapted to be positioned closely adjacent the back wall of the fireplace, the space within said C-shaped member being completely open, and said leg portions being spaced apart by a maximum distance of approximately 20 inches so that logs can extend between and be supported on said leg portions, whereby said logs extend over the open space within said C-shaped member;

leg means attached to said andiron means and projecting downwardly therefrom for supporting said andiron means in a substantially horizontal plane spaced upwardly above a supporting floor, said leg means including a plurality of leg elements attached to said C-shaped member and projecting downwardly therefrom, said leg elements being disposed directly under the pipelike portions forming the C-shaped member;

one of said pipelike leg portions having a discharge opening formed in the free end thereof for permitting a substantially horizontally directed stream of heated air to be discharged from said C-shaped member, said discharge opening as formed in the free end of said one leg portion comprising the sole discharge opening for the discharge of heated air from said C-shaped member, the other pipelike leg portion being closed in the vicinity of the free end thereof;

an air supply pipe connected to said other pipelike leg portion for supplying cool air into the interior of said C-shaped member, said air supply pipe being separable from said C-shaped member and having one end thereof releasably connected to said other pipelike leg portion at a location spaced inwardly from the closed free end thereof, said air supply pipe being disposed within substantially the same plane as said C-shaped member and extending outwardly therefrom in substantially transverse relationship to said other pipelike leg portion;

means associated with the other end of said air supply pipe for supplying cool air through said air supply pipe means into said C-shaped member; and an elongated log holding element associated with each of said pipelike leg portions and projecting upwardly therefrom for engaging the logs which are supported on said C-shaped element and for preventing the logs from rolling out of the fireplace, the elongated log holding elements being located on the pipelike leg portions in the vicinity of but spaced inwardly from the free ends thereof.

5. A heater-andiron according to claim 4, wherein said log holding element as associated with each said leg portion is removably mounted on the respective leg portion.

6. A combination heater-andiron for a fireplace, comprising:

a C-shaped section formed from a hollow pipe, said C-shaped section including a pair of substantially parallel leg portions interconnected by a center portion;

leg means attached to said C-shaped section and projecting downwardly therefrom for supporting said C-shaped section on but spaced upwardly from a floor;

supply pipe means fixedly connected to one of said leg portions adjacent the free end thereof, said supply pipe means extending transversely of said leg portion and having fan means associated therewith for supplying air into and through said supply pipe means and into the interior of said C-shaped section;

said C-shaped section having a discharge opening formed therein adjacent the free end of said other leg portion;

log holding means for maintaining the logs supported on and extending transversely between said leg portions, said log holding means including a log holding member projecting upwardly from each leg portion;

said leg portions being spaced apart by a distance sufficient to permit the logs to be positioned directly on and extend transversely between said leg portions, and the region between said leg portions as defined within said C-shaped section being completely free and open;

said leg means including a plurality of leg elements attached to said C-shaped section and projecting downwardly therefrom, said leg element including a leg part disposed directly under the leg portion of the C-shaped section, said leg part projecting upwardly through opening means formed in said leg portion and having an upper part which projects upwardly above said leg portion, said upper part constituting said log holding member;

said leg member having shoulder means formed thereon and adapted to abut said C-shaped section for supporting said C-shaped section at a desired elevation above the floor, and the portion of said leg member spaced upwardly above said shoulder being slidably insertable through the opening means formed in said leg portion so as to project upwardly above said leg portion and form said log holding member.

7. A heater-andiron according to claim 6, wherein said C-shaped section is formed from a hollow pipe having a cross-sectional dimension of between 2½ and 3½ inches, and wherein said leg portions are spaced apart by a distance in the range of approximately 16 to 20 inches, and wherein said leg means space said C-shaped section upwardly above the floor by a distance in the range of 2 to 3 inches.

8. A heater-andiron according to claim 6, wherein said shoulder means abuts the lower surface of said C-shaped section.

9. A heater-andiron according to claim 6, wherein said leg members are separable from said C-shaped section, said C-shaped section and said leg members being connected together by slidably inserting said leg members through said opening means.

* * * * *